US007258248B2

(12) United States Patent
Kim

(10) Patent No.: US 7,258,248 B2
(45) Date of Patent: Aug. 21, 2007

(54) TABLET CASSETTE FOR MEDICINE PACKING MACHINE

(75) Inventor: Jun-ho Kim, Dalseo-Gu (KR)

(73) Assignee: JVM Co., Ltd., Daegu (KR)

( * ) Notice: Subject to any disclaimer, the term of this patent is extended or adjusted under 35 U.S.C. 154(b) by 226 days.

(21) Appl. No.: 11/033,263

(22) Filed: Jan. 12, 2005

(65) Prior Publication Data

US 2005/0230413 A1 Oct. 20, 2005

(30) Foreign Application Priority Data

Apr. 20, 2004 (KR) ..... 10-2004-0027163
Jun. 10, 2004 (KR) ..... 10-2004-0042734

(51) Int. Cl.
*B65H 3/60* (2006.01)

(52) U.S. Cl. ..... 221/203; 221/265; 221/130; 221/131

(58) Field of Classification Search ..... 221/203, 221/162, 167, 168, 169, 173, 277
See application file for complete search history.

(56) References Cited

U.S. PATENT DOCUMENTS 5,765,606 A * 6/1998 Takemasa et al. ..... 141/104
5,864,342 A * 1/1999 Kajiya et al. ..... 345/418
6,170,229 B1 * 1/2001 Kim ..... 53/155
6,394,308 B1 * 5/2002 Yuyama et al. ..... 221/265
6,405,893 B1 * 6/2002 Tobe et al. ..... 221/2
6,585,132 B2 * 7/2003 Kim ..... 221/133

* cited by examiner

*Primary Examiner*—Gene O. Crawford
*Assistant Examiner*—Timothy Waggoner
(74) *Attorney, Agent, or Firm*—Oblon, Spivak, McClelland, Maier & Neustadt, P.C.

(57) ABSTRACT

A tablet cassette for a medicine packing machine is disclosed. The tablet cassette for a medicine packing machine includes a cassette for accommodating tablets and having a passage formed at one side of a lower end thereof, a cassette support with which the cassette is detachably coupled on the upper surface of the cassette support and which has an inclined passage communicated with the passage in one side thereof, and a discharge driver provided in the cassette and the cassette support. The discharge driver includes a conic rotating body provided in the cassette and having divisional protrusions on the outer circumference thereof, and a driving motor provided in the cassette support to rotate the rotating body in a forward direction and to rotate the rotating body in a reverse direction when tablets are lodged such that an overload is generated.

5 Claims, 13 Drawing Sheets

TABLET CASSETTE FOR MEDICINE PACKING MACHINE

BACKGROUND OF THE INVENTION

1. Field of the Invention

The present invention relates to a tablet cassette for a medicine packing machine, and more particularly, to a tablet cassette for a medicine packing machine capable of easily releasing lodged tablets without damage.

2. Description of the Related Art

Generally, a medicine packing machine is an apparatus for receiving tablets from a tablet cassette and a tablet discharging device according to medicines and for continuously dosing the tablets.

An example of the above-described conventional tablet packing machine will now be described with reference to FIG. 12.

As illustrated in FIG. 12, the medicine packing machine includes a plurality of tablet cassettes 100 in a shelf positioned in an upper portion, a tablet discharging device 200 in a lower portion, a hopper 300 below the tablet cassettes 100 and the tablet discharging device 200, and a sealing portion 500 for transferring the packing paper, printed upon by a printer 400, to seal the packing paper.

The structure and operation of the conventional tablet cassettes provided in the conventional medicine packing machine will now be described with reference to FIG. 13.

As illustrated in FIG. 13, the conventional tablet cassette includes a cassette 101 receiving tablets are received and having a passage 102 formed at a lower side thereof, a cassette support 103 in which the cassette 101 is detachably installed to the upper side of the cassette support 103 and which has an inclined passage 104 communicated with the passage 102 at one side thereof, and a discharge driver 105 provided in the cassette 101 and the cassette support 103.

The discharge driver 105 includes a rotating body 108 having a plurality of divisional protrusions 106 formed on the outer circumference thereof and step-shaped jaws 107 formed on the upper surface thereof at regular intervals, and a driving motor 109 for rotating the rotating body 108 in a forward direction. The tablets received in the cassette 101 climb over the jaws 107 due to the rotation of the rotating body 108 caused by the driving of the driving motor 109 and are received in thein spaces between the divisional protrusions 106 while sliding along the upper surface of the rotating body 108, one by one, to be discharged through the passage 102 and the inclined passage 104.

The plurality of tablets are mixed with each other to be lodged in a state where the tablets are stacked in the space between the rotating body and the inner surface of the cassette above the upper side of the divisional protrusions due to the driving of the driving motor.

Also, since the rotating body continuously rotates due to the driving of the driving motor in a state where the tablets are lodged, the tablets are sandwiched in the space between the rotating body and the inner surface of the cassette due to the rotary force such that the tablets are easily damaged.

Although the damaged tablets are discharged, the tablets' powder remains in the cassette such that the powder is mixed with other tablets. Since the tablets are lodged, the normal discharge of the tablets is interrupted.

SUMMARY OF THE INVENTION

Therefore, the present invention has been made in view of the above and/or other problems, and it is an object of the present invention to provide a tablet cassette for a medicine packing machine capable of easily releasing lodged tablets without damage.

It is another object of the present invention to provide a tablet cassette for a medicine packing machine capable of easily removing the residual powder of the tablets remained within the cassettes.

It is another object of the present invention to provide a tablet cassette for a medicine packing machine capable of preventing lodging, sandwiching, or accumulation of capsules so as to stably release and discharge the capsules.

It is another object of the present invention to provide a tablet cassette for a medicine packing machine capable of moving a brush up and down such that capsules with different lengths can be sorted and discharged by using a single tablet cassette.

In accordance with the present invention, the above and other objects can be accomplished by the provision of a tablet cassette for a medicine packing machine including a cassette for accommodating tablets and having a passage formed at one side of a lower end thereof, a cassette support with which the cassette is detachably coupled on the upper surface of the cassette support and which has an inclined passage communicated with the passage in one side thereof, and a discharge driver provided in the cassette and the cassette support, wherein the discharge driver drives a conic rotating body provided in the cassette and having divisional protrusions on the outer circumference thereof, and a driving motor provided in the cassette support to rotate the rotating body in a forward direction and to rotate the rotating body in a reverse direction when tablets are lodged such that overload is generated.

Preferably, the driving motor is a synchronous motor that rotates in synchronization with the frequency of a power source and that reversely rotates after temporarily stopping when the synchronization of the synchronous motor with the power source is released.

According to one aspect of the present invention, a plurality of inclined round jaws are formed on the conic upper surface of the rotating body at regular intervals to be symmetrically curved, and perpendicular curved surfaces are formed at the leading ends of the round jaws to have the same circumference as the outer circumference of the rotating body.

The tablet cassetter further includes a plurality of discharge through holes formed in the inside bottom surface of the cassette corresponding to the bottom surface of the divisional protrusions, and a collecting box provided between the bottom surface of the cassette and the upper surface of the cassette support to be inserted and withdrawn in the front direction such that the powders discharged through the discharge through holes are collected.

In accordance with the present invention, the above and other objects can be accomplished by the provision of a tablet cassette for a medicine packing machine, including a cassette for accommodating tablets, a cassette support in which the cassette is mounted, a rotating body rotably installed in the cassette, a driving motor installed in the cassette support so as to rotate the rotating body, and a brush protruded from the rear side of the cassette to the inside of the cassette, wherein the rotating body includes a plurality of divisional protrusions provided on the outer circumference of a cylindrical body whose conic upper surface to be spaced apart from each other and to be perpendicular so as to form tablet chutes, and divisional grooves formed in the divisional protrusions such that the brush is inserted therein.

The tablet cassette further includes side inclined surfaces provided on both upper sides of the divisional protrusions such that the chutes are reversely tapered.

Preferably, inverse triangular protrusions are formed on the divisional protrusions to be vertically tapered.

The divisional grooves are larger than the thickness of the brush such that the brush moves vertically.

Preferably, the divisional protrusions have heights different from those of neighboring divisional protrusions.

The tablet cassette further includes a plurality of inclined round jaws formed on the conic upper surface of the rotating body at regular intervals to be symmetrically curved.

Preferably, downwardly inclined surfaces are provided on the upper surface of the divisional protrusions toward the outside.

Preferably, protrusions protruded from the center of the downward inclined surfaces above the downward inclined surfaces.

BRIEF DESCRIPTION OF THE DRAWINGS

These and/or other objects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, preferred embodiments of the present invention will be described in detail with reference to the attached drawings.

Figure 1:
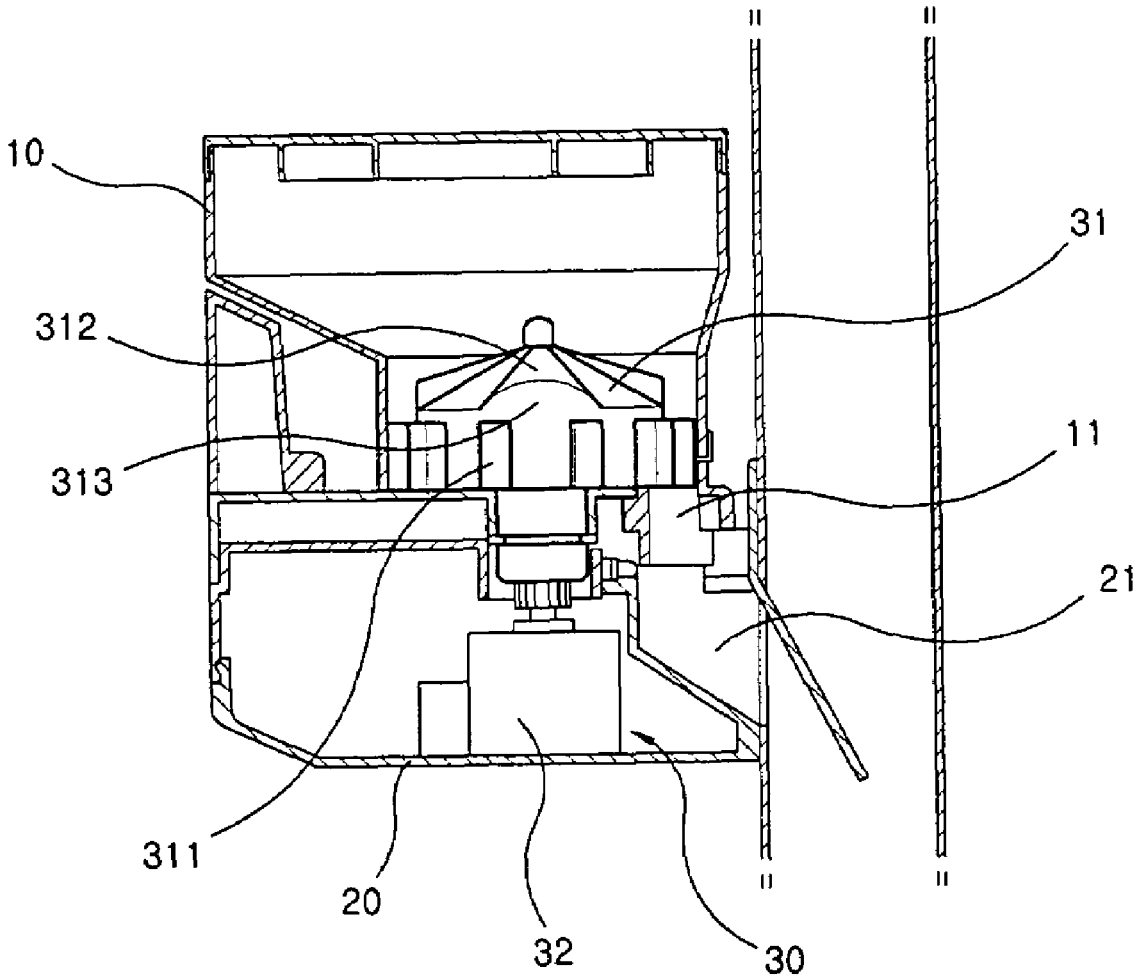
FIG. 1 is a schematic vertical sectional view illustrating a tablet cassette for a medicine packing machine according to a first embodiment of the present invention.

FIG. 1 is a schematic vertical sectional view illustrating a tablet cassette for a medicine packing machine according to a first embodiment of the present invention.

As illustrated in FIG. 1, the tablet cassette includes a cassette 10 for accommodating tablets, a cassette support 20 in which the cassette 10 is coupled on the upper side of the cassette support 20, and a discharge driver 30 for discharging the tablets accommodated in the cassette 10 to the outside.

The cassette 10 includes a passage 11 in one side in a lower side thereof through which tablets are discharged one by one.

The discharge driver 30 includes a rotating body 31 rotatably installed in the cassette 10 and a driving motor 32 provided in the cassette support 20 such that the driving motor 32 is detachably installed to the lower end of the rotating body 31.

Here, according to the discharge driver 30, the rotating body 31 coupled with the discharge driver 30 is rotated by the driving of the driving motor 32 such that the tablets accommodated in the cassette 10 are discharged via the passage 11 and the inclined passage 21 one by one by the rotating body 31.

The conical rotating body 31 includes a plurality of divisional protrusions 311 formed on the outer circumference of the rotating body 31 at regular intervals, a plurality of curve-shaped round jaws 312 inclined upward to be symmetrically formed at regular intervals, and perpendicular curved surfaces 313 formed at the leading end of the round jaws 312.

Here, the round jaws 312 guide the tablets to enter the spaces between the divisional protrusions 311 regardless of the rotating direction of the rotating body 31 due to the driving motor 32 and are symmetrically curved such that it is possible to prevent the tablets from being damaged although the rotating direction of the rotating body 31 changes due to the driving motor 32.

The perpendicular curved surfaces 313 are formed to have the same circumference as the outer circumference of the rotating body 31 such that the leading end of the perpendicular curved surfaces 313 are vertical. The perpendicular curved surfaces 313 allow the tablets to climb over the round jaws 312 and to directly enter the spaces between the divisional protrusions 311 without accumulation.

The round jaws 312 are formed to be inclined such that the width thereof is gradually reduced toward the upper ends thereof. Three round jaws 312 are formed on the upper surface of the rotating body 31 at intervals of 120° such that the valleys between the round jaws 312 are formed at intervals of 60°. Therefore, the tablets uniformly and smoothly slide through the above-described valleys and enter the spaces between the divisional protrusions 311.

The driving motor 32 rotates the rotating body 31 in the forward direction and, when the tablets are lodged and overload is generated due to the lodging of the tablets, rotates the rotating body 31 in the reverse direction such that it is possible to easily release the lodged tablets and to thus smoothly discharge the tablets.

The driving motor 32 is preferably a synchronous motor that rotates in synchronization with the frequency of a power source and that reversely rotates after temporarily stopping.

This is because the synchronous motor easily changes the rotating direction without connection and disconnection of the power source and without being controlled when overload is generated.

Therefore, the tablet cassette according to the present invention has a simple structure in which the rotating direction of the rotating body 31 changes when the tablets are lodged such that it is possible to easily release the lodged tablets and to thus stably discharge the tablets.

Figure 2:
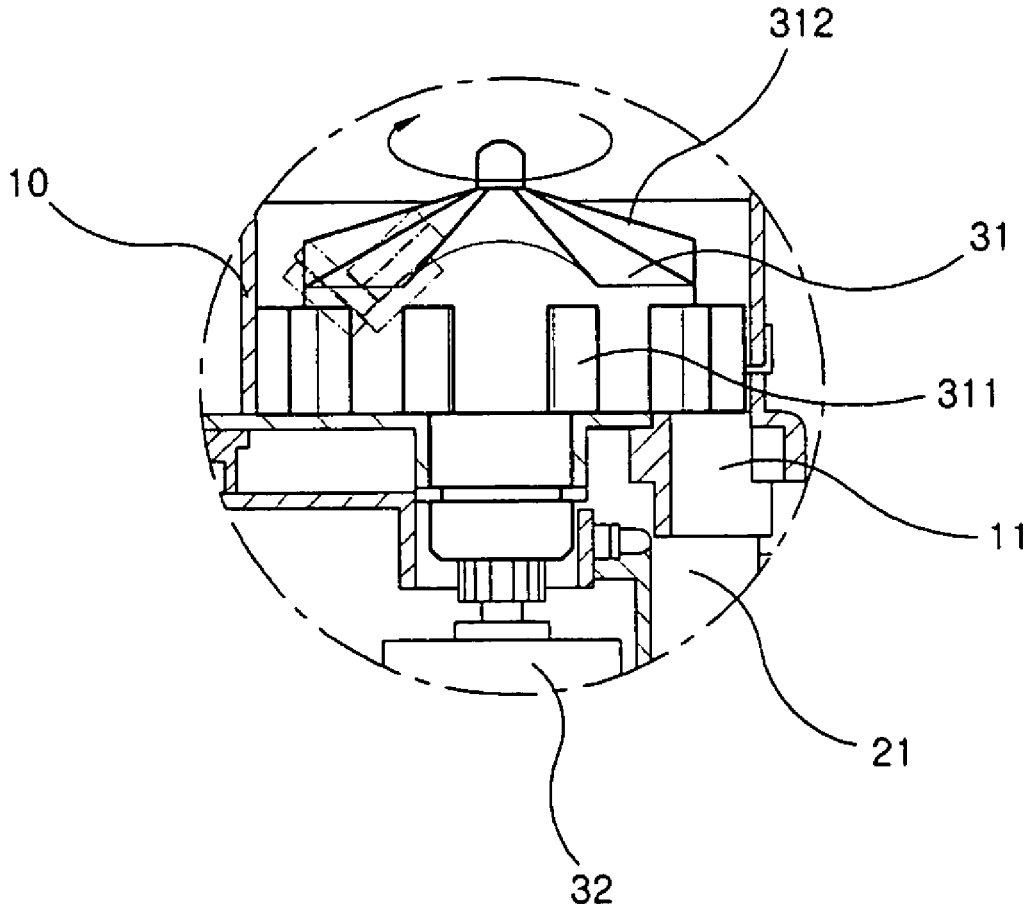
FIG. 2 is an enlarged vertical sectional view illustrating main parts of the tablet cassette for a medicine packing machine according to the first embodiment of FIG. 1 that rotate in the forward direction.
Figure 3:
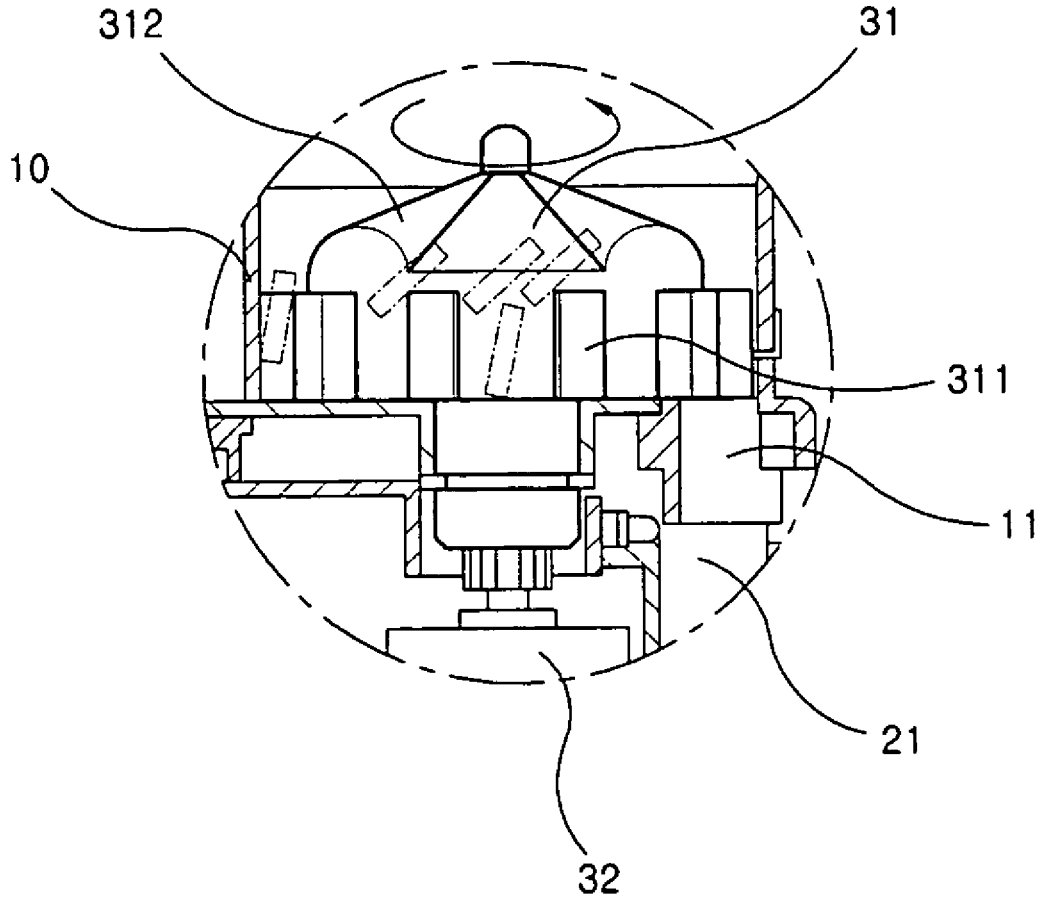
FIG. 3 is an enlarged vertical sectional view illustrating the main parts of the tablet cassette for a medicine packing machine according to the first embodiment of FIG. 1 that rotate in the reverse direction.

FIG. 2 is an enlarged vertical sectional view illustrating main parts of the tablet cassette for a medicine packing machine according to the first embodiment of FIG. 1 that rotate in the forward direction, and FIG. 3 is an enlarged vertical sectional view illustrating main parts of the tablet cassette for a medicine packing machine according to the first embodiment of FIG. 1 that rotate in the reverse direction.

As illustrated in FIGS. 2 and 3, the tablets accommodated in the cassette 10 are mixed with each other due to the forward direction rotation of the rotating body 31 rotated by the driving motor 32, are pushed by the round jaws 312, are received in the spaces between the divisional protrusions 311, and are discharged through the passage 11 and the inclined passage 21.

At this time, when the plurality of tablets are accumulated by becoming lodged between the outer circumference of the rotating body 31 and the inner surface of the cassette 10 in the upper sides of the divisional protrusions 311, the rotating body 31 stops and, accordingly, the driving motor 32 that drives the rotating body 31 stops such that overload is generated.

As described above, the driving motor 32 stops such that an overload is generated, the driving motor 32 reversely rotates such that the accumulated and lodged tablets are released.

At this time, the driving motor 32 continuously rotates in the reverse direction to push the released tablets to the round jaws 312 of the rotating body 31 such that the tablets enter the spaces between the divisional protrusions 311 so as to be discharged through the passage 11 and the inclined passage 21.

As described above, when the tablets again become lodged and stop the driving in a state where the driving motor 32 reversely rotates, the driving motor 32 rotates in a forward direction such that the lodged tablets are released and are continuously discharged.

Therefore, the driving motor 32 alternately rotates the rotating body 31 in forward and reverse directions when the tablets are lodged such that the tablets are stably discharged without being damaged.

Figure 4:
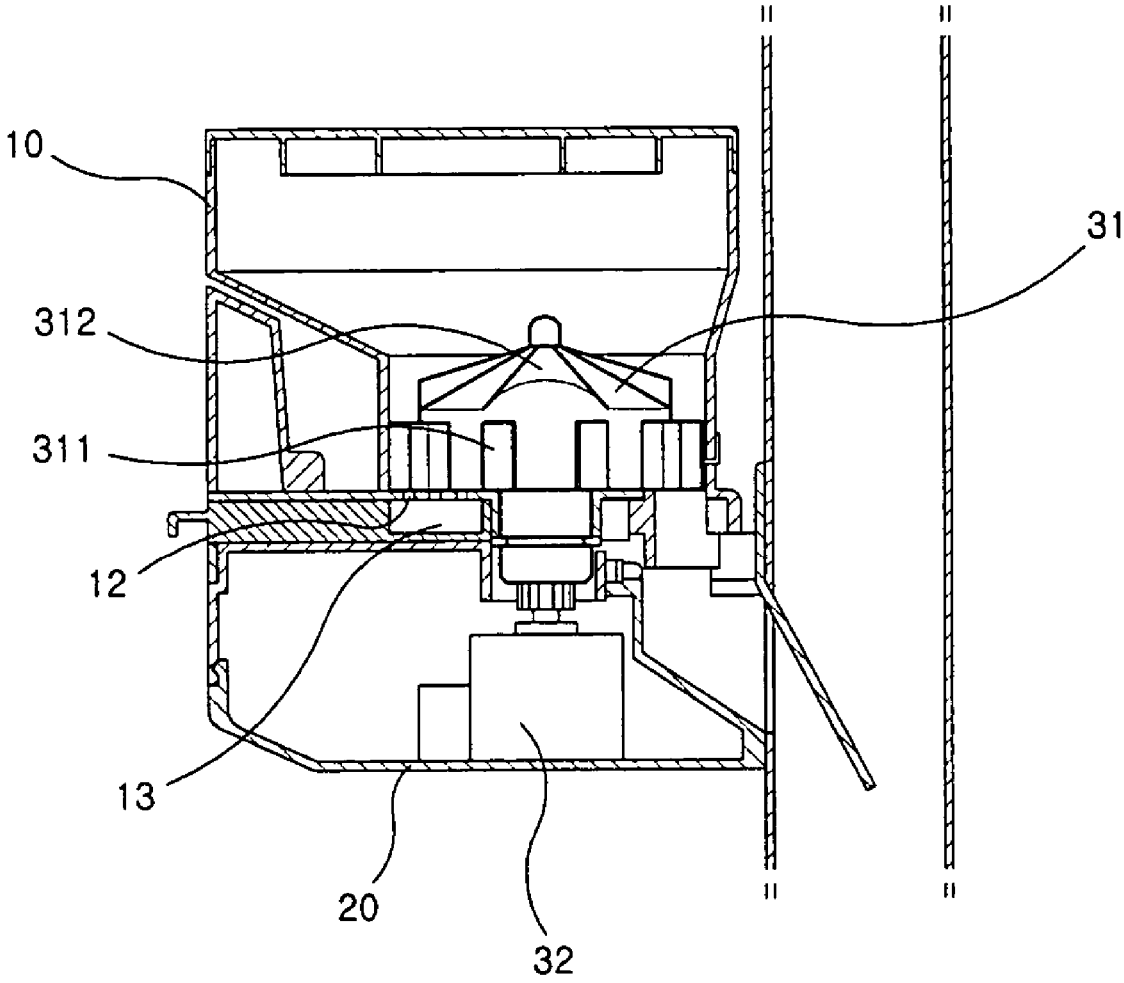
FIG. 4 is a schematic vertical sectional view illustrating a tablet cassette for a medicine packing machine according to a second embodiment of the present invention.
Figure 5:
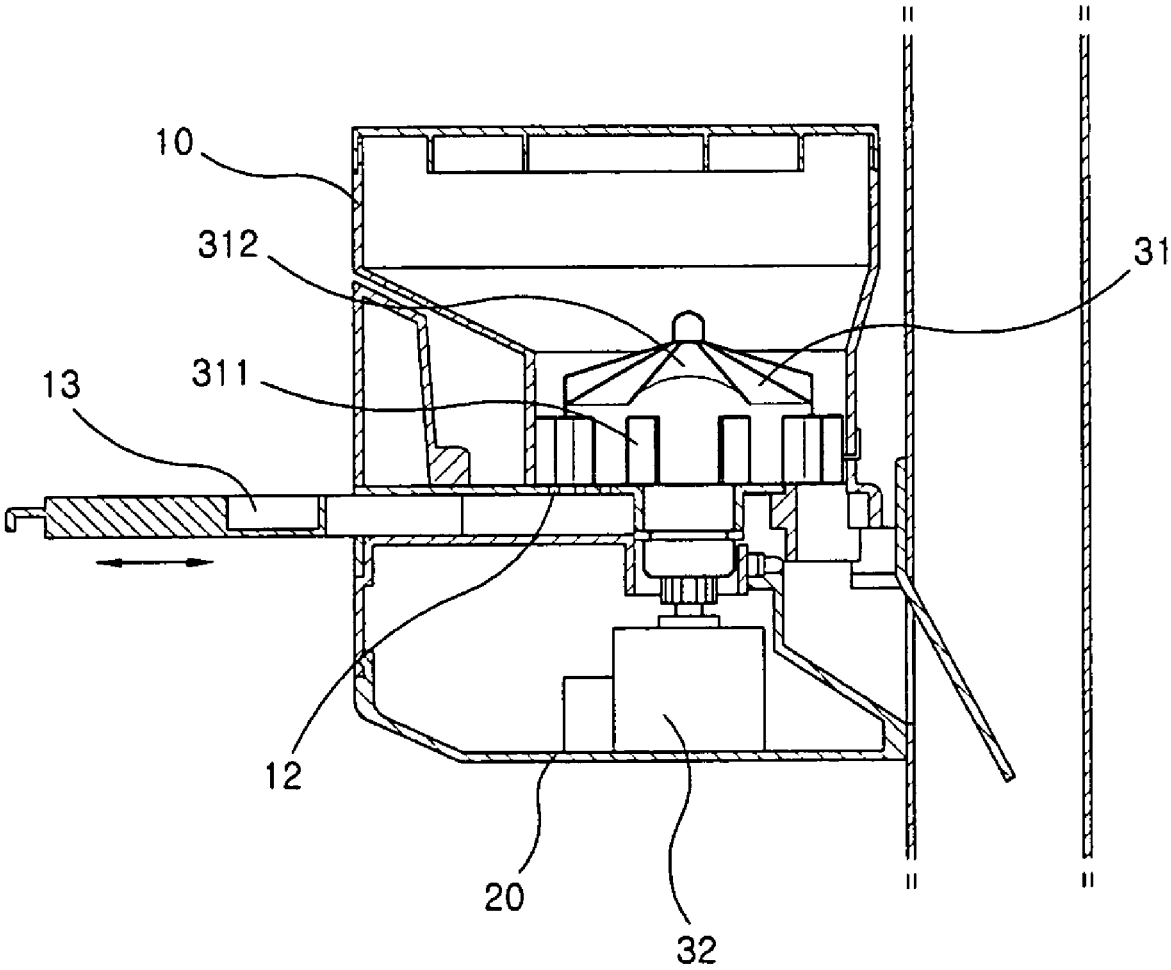
FIG. 5 is a vertical sectional view illustrating an operational state of the tablet cassette for a medicine packing machine according to the second embodiment of FIG. 4.

FIG. 4 is a schematic vertical sectional view illustrating a tablet cassette for a medicine packing machine according to a second embodiment of the present invention, and FIG. 5 is a vertical sectional view illustrating an operational state of the tablet cassette for a medicine packing machine according to the second embodiment of FIG. 4.

As illustrated in FIGS. 4 and 5, in the tablet cassette according to the present invention, a plurality of discharge through holes 12 are formed in the inside bottom surface of the cassette 10 corresponding to the bottom surface of the divisional protrusions 311 of the rotating body 31 and a collecting box 13 is provided between the lower surface of the cassette 10 and the upper surface of the cassette support 20 to be inserted and withdrawn in the front direction such that the powders discharged through the discharge through holes 12 are collected.

Here, the discharge through holes 12 serve as passages through which the powders of the tablets generated when the plurality of tablets accommodated in the cassette 10 collide with each other are discharged such that the tablets that are accommodated the spaces between the divisional protrusions 311 and that are about to be discharged are rotated by the rotating body 31 in a state where the tablets contact the inside bottom surface of the cassette 10 to naturally push the powders to the discharge through holes 12.

As described above, the powders which have naturally entered the discharge through holes 12 by the tablets fall to the outside lower surface of the cassette 10 and are collected in the collecting box 13.

Therefore, the powders of the tablets are automatically collected in the collecting box 13 through the discharge through holes 12 in accordance with the rotation of the rotating body 31 caused by the driving motor 32.

The collecting box 13 is inserted and withdrawn in the front direction between the lower surface of the cassette 10 and the upper surface of the cassette support 20 such that a user can easily withdraw the collecting box 13 in the front direction of the cassette 10 to remove the collected powders.

Figure 6:
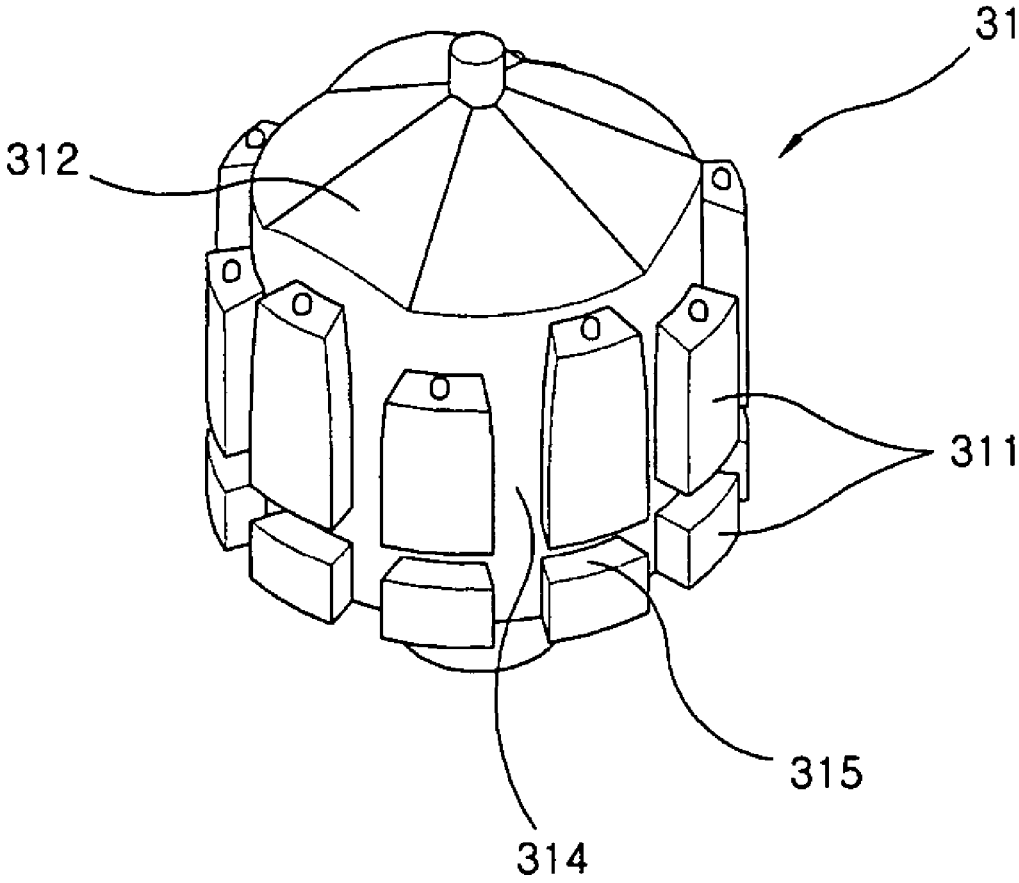
FIG. 6 is a perspective view illustrating a rotating body of a tablet cassette for a medicine packing machine according to a third embodiment of the present invention.
Figure 7:
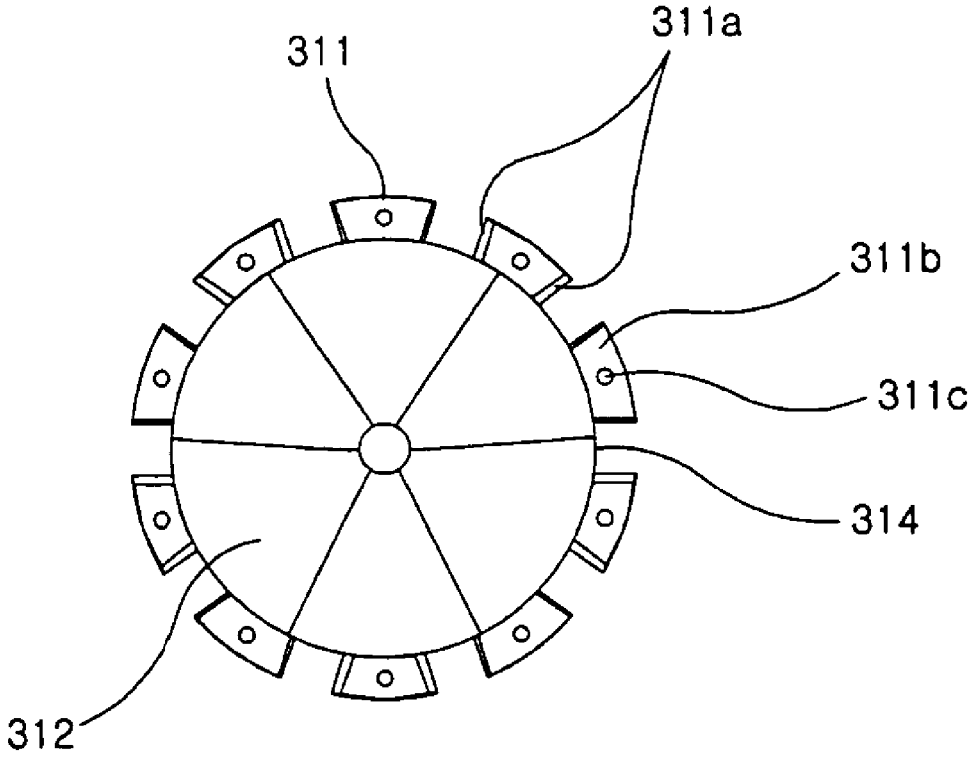
FIG. 7 is a plan view of the rotating body of a tablet cassette for a medicine packing machine of FIG. 6.
Figure 8:
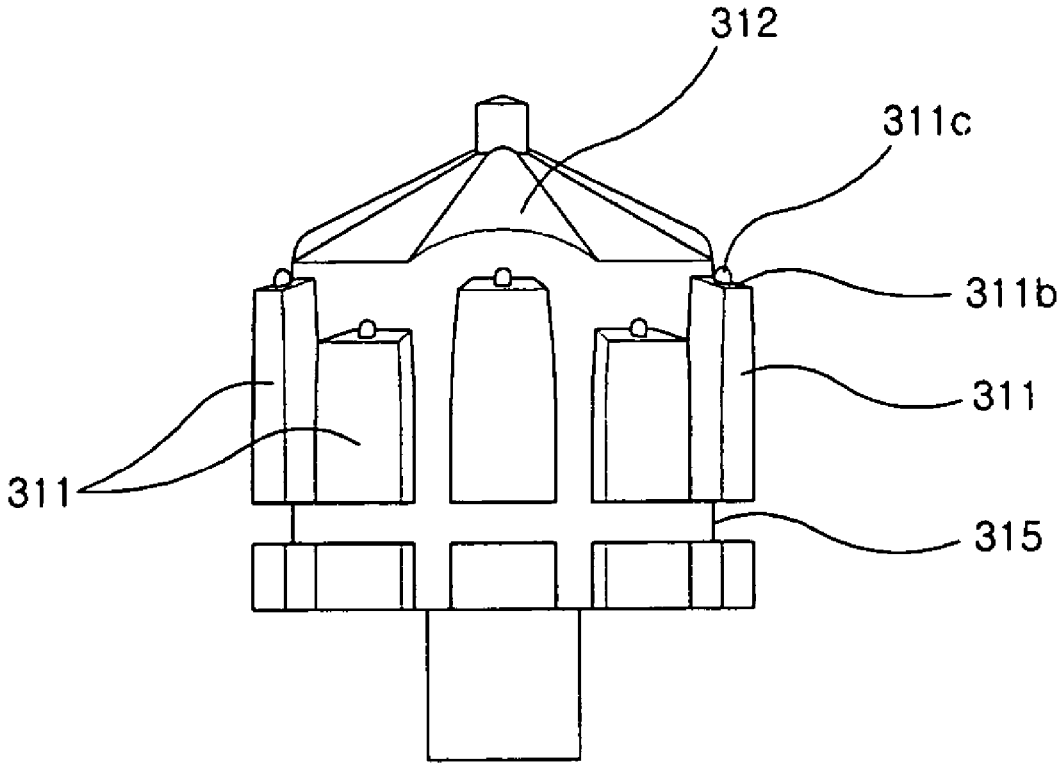
FIG. 8 is a side view of the rotating body of the tablet cassette for a medicine packing machine of FIG. 6.

FIG. 6 is a perspective view illustrating a rotating body of a tablet cassette for a medicine packing machine according to a third embodiment of the present invention, FIG. 7 is a plan view of the rotating body of a tablet cassette for a medicine packing machine of FIG. 6, and FIG. 8 is a side view of the rotating body of the tablet cassette for a medicine packing machine of FIG. 6.

As illustrated in FIGS. 6 to 8, the rotating body 31 of the tablet cassette includes a plurality of divisional protrusions 311 formed on the outer circumference of a cylindrical body whose upper surface is conical, chutes 314 formed between the divisional protrusions 311, divisional grooves 315 formed in the divisional protrusions 311, and a plurality of round jaws 312 formed on the upper surface of the cylindrical body.

The rotating body 31 is rotated by the driving of the driving motor 32 to sort the tablets accommodated in the cassette and to discharge the tablets one by one.

The divisional protrusions 311 are vertically protruded to be spaced apart from each other such that the plurality of chutes 314 are formed on the outer circumference of the rotating body 31. Side inclined surfaces 311*a* formed on both upper sides of the divisional protrusions 311 form the upper sides of the chutes 314 wide such that the tablets can be smoothly entered through the chutes 314.

Downwardly inclined surfaces 311*b* formed on the upper surface of the divisional protrusions 311 are downwardly inclined toward the outside of the rotating body 31 such that the tablets are not accumulated on the upper surfaces of the divisional protrusions 311.

Protrusions 311*c* protruded from the downwardly inclined surfaces 311*b* serve to prevent the tablets from being accumulated on the upper surfaces of the divisional protrusions 311.

The divisional protrusions 311 have heights different from the heights of neighboring divisional protrusions 311 such that neighboring divisional protrusions 311 form steps. Therefore, it is possible to prevent a plurality of tablets from simultaneously entering the chutes 314 from the upper ends of the divisional protrusions 311 such that it is possible to prevent the tablets from being sandwiched or lodged.

The divisional grooves 315 are formed in the divisional protrusions 311 such that a brush 33 installed at the rear side of the cassette is inserted therein. Therefore, the tablets, which fall through the chutes 314 into the spaces between the divisional protrusions 311, are sorted and discharged one by one by the brush 33.

The divisional grooves 315 are larger than the thickness of the brush 33 such that the brush 33 can move vertically in the divisional grooves 315 and that tablets having different lengths can be smoothly sorted.

The round jaws 312 are symmetrically inclined on the conical upper surface of the rotating body 31 at regular intervals and have curved shapes. The round jaws 312 guide the plurality of tablets accommodated on the upper surface of the rotating body 31 in the cassette to be introduced to the chutes 314.

Therefore, the rotating body 31 prevents the tablets from being sandwiched or accumulated, and stably sorts and discharges the tablets.

Figure 9:
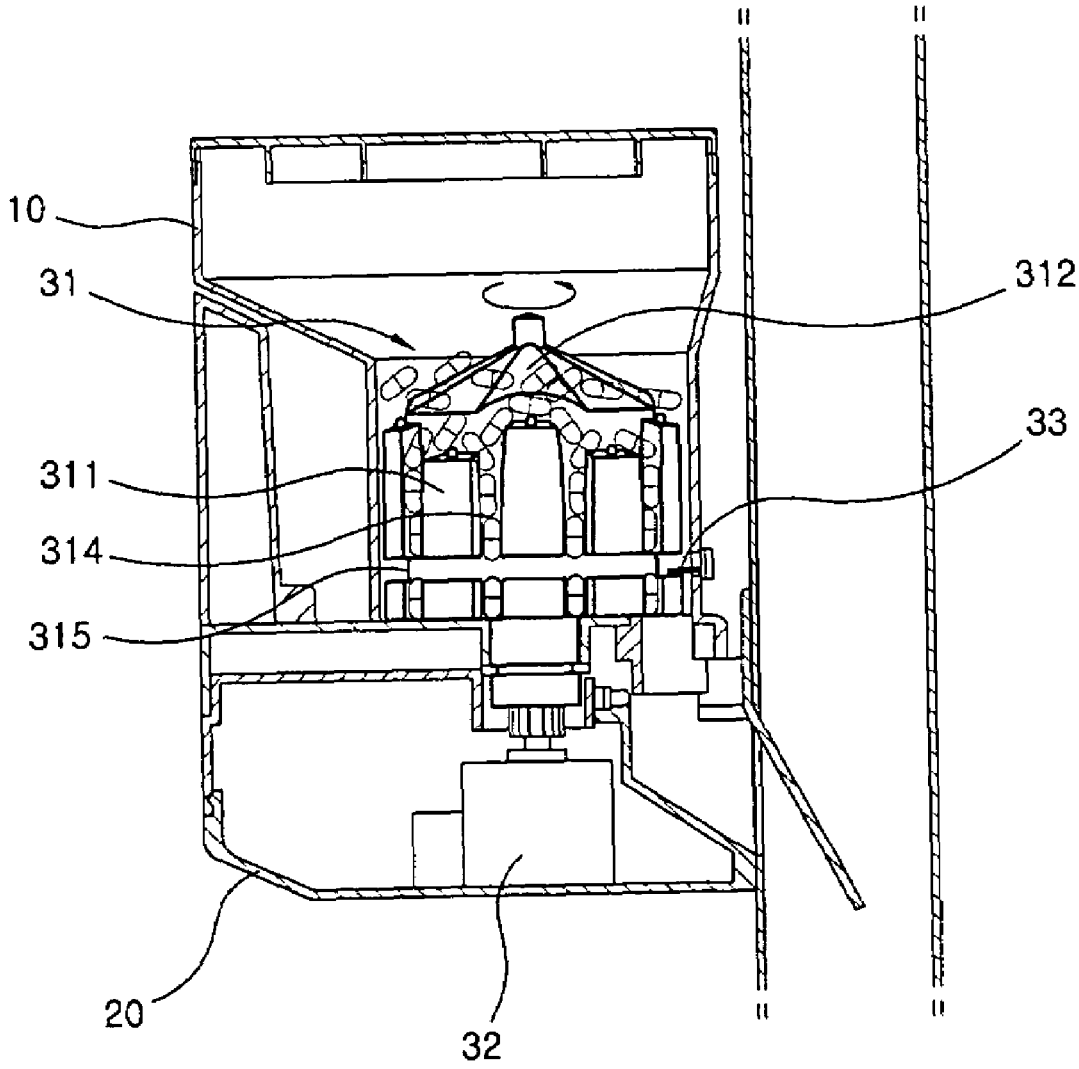
FIG. 9 is a schematic side view illustrating a state in which tablets are discharged by the tablet cassette for a medicine packing machine according to the third embodiment.

FIG. 9 is a schematic side view illustrating a state in which tablets are discharged by the tablet cassette for a medicine packing machine according to the third embodiment.

As illustrated in FIG. 9, the rotating body 31 and the driving motor 32 are coupled with each other in a state where the cassette 10 is mounted on the cassette support 20 with tablets in the shape of capsules accommodated in the cassette 10.

When the driving motor 32 is driven in such a state, the rotating body 31 rotates such that the tablets accommodated in the cassette 10 move to the outside of the rotating body 31 along the round jaws 312 to fall through the chutes 314 formed between the steped divisional protrusions 311.

The tablets falling through the chutes 314 are sorted by the brush 33 inserted into the divisional grooves 315 and are discharged one by one.

Figure 10:
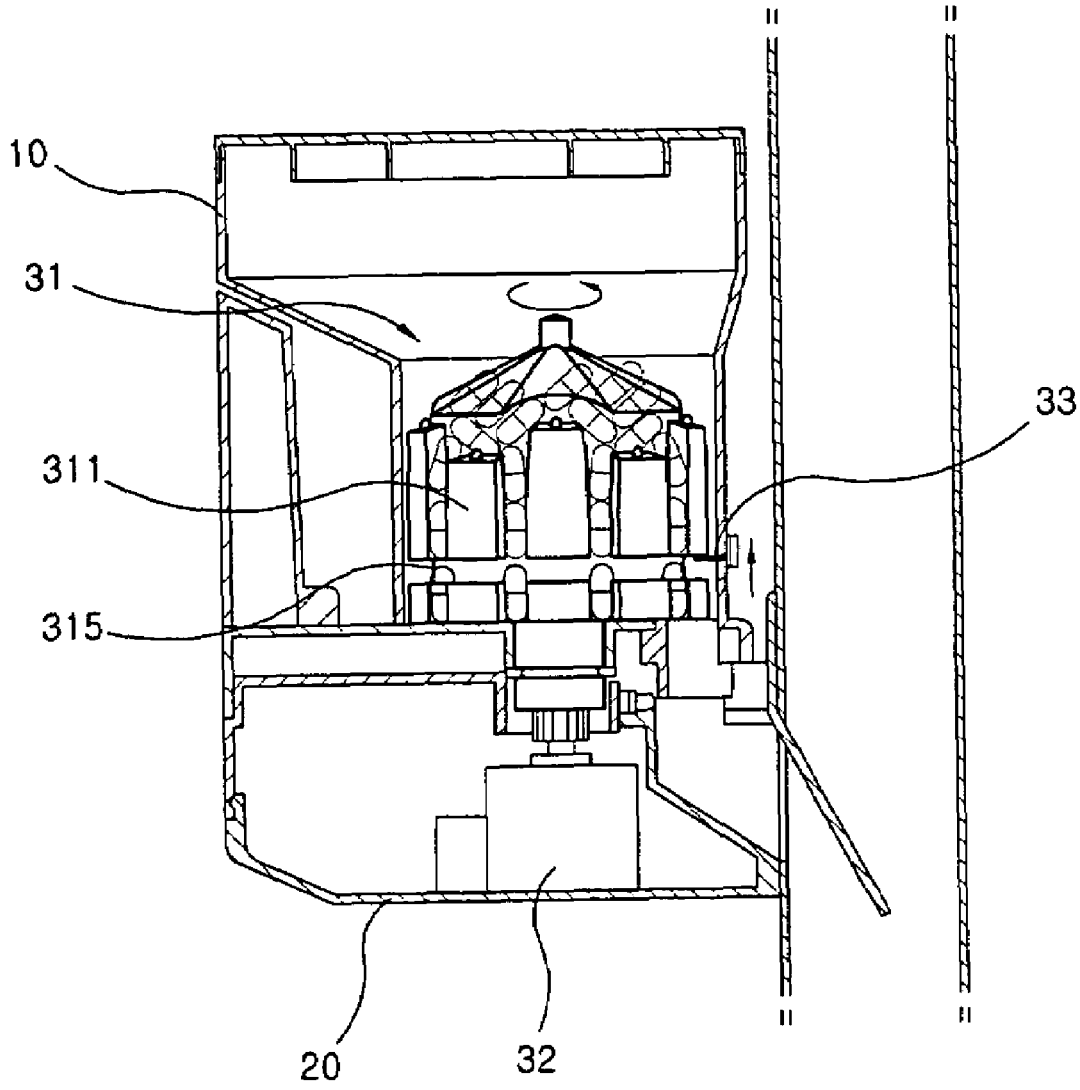
FIG. 10 is a schematic side view illustrating a state in which long tablets are discharged by the tablet cassette for a medicine packing machine according to the third embodiment.

FIG. 10 is a schematic side view illustrating a state in which long tablets are discharged by the tablet cassette for a medicine packing machine according to the third embodiment.

As shown in FIG. 10, when the tablets in the shape of long capsules are accommodated in the cassette 10, the brush 33 mounted in the rear side of the cassette 10 is moved upward in accordance with the length of the tablets and is mounted again such that the tablets are smoothly sorted by the divisional grooves 315 formed in the divisional protrusions 311.

That is to say, since the divisional grooves 315 are wider than the thickness of the brush 33, the brush 33 can be moved vertically. Therefore, it is possible to sort and to discharge tablets having different lengths using one tablet cassette, and a variety of apparatuses can employ the tablet cassette.

Therefore, when the rotating body 31 is rotated by driving the driving motor 32 of the cassette support 20 after adjusting the height of the brush 33 in accordance with the lengths of the tablets in a state where the long tablets are accommodated in the cassette 10, the tablets having various lengths are smoothly discharged.

Figure 11:
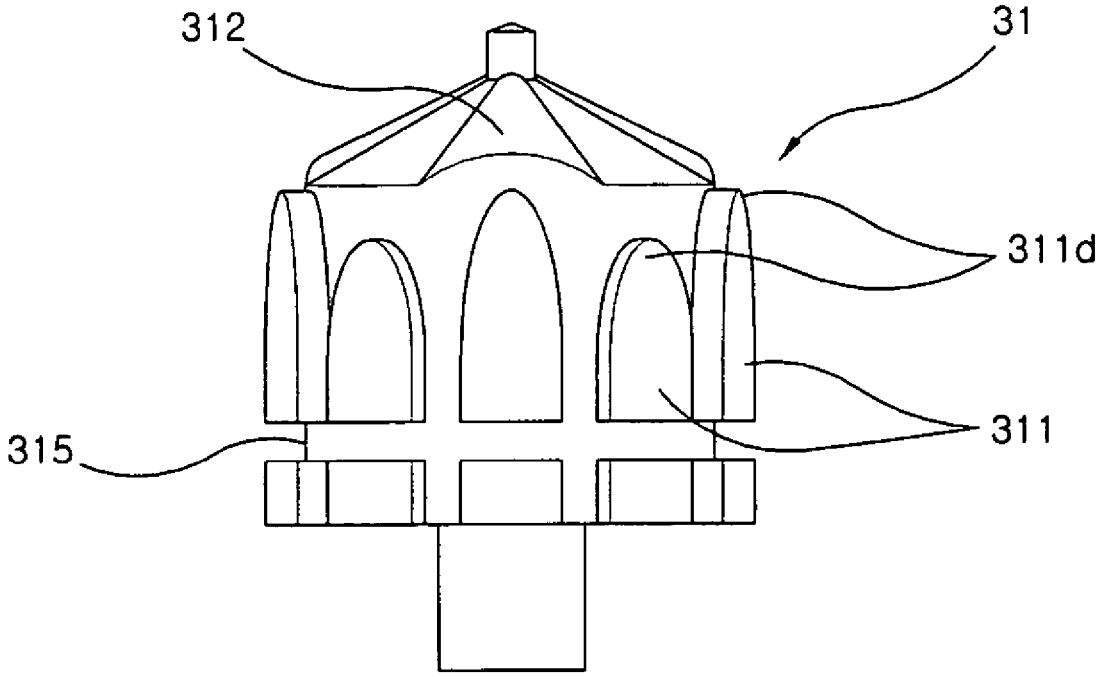
FIG. 11 is a side view illustrating a tablet cassette for a medicine packing machine according to a fourth embodiment of the present invention.
Figure 12:
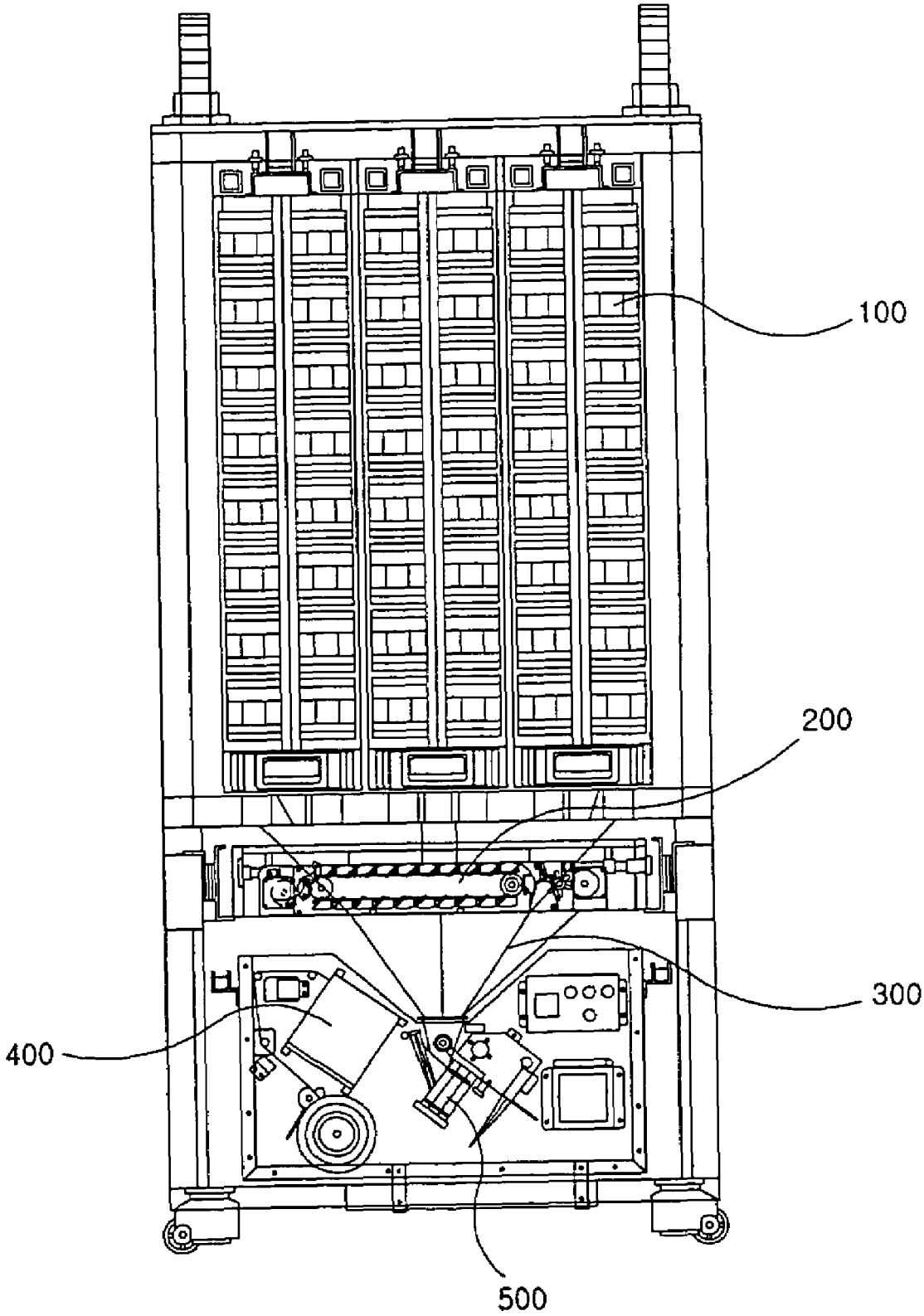
FIG. 12 is a schematic front sectional view illustrating a conventional medicine packing machine.
Figure 13:
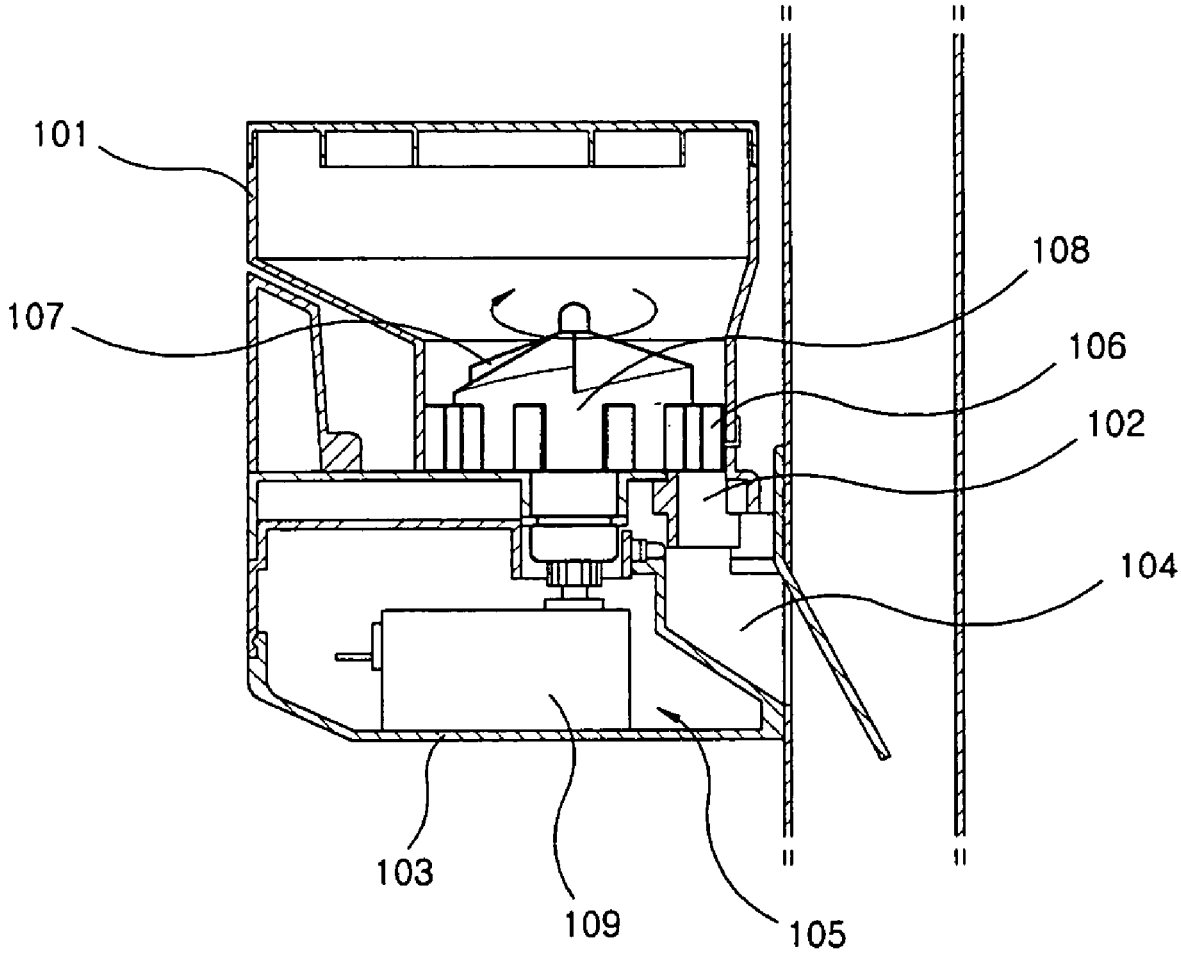
FIG. 13 is a schematic vertical sectional view illustrating the conventional tablet cassette.

FIG. 11 is a side view illustrating a tablet cassette for a medicine packing machine according to a fourth embodiment of the present invention.

As illustrated in FIG. 11, the rotating body 31 of the tablet cassette includes a plurality of divisional protrusions 311 formed on the outer circumference of a cylindrical body whose upper surface is conical, a plurality of round jaws 312 formed on the upper surface of the cylindrical body, and divisional grooves 315 formed in the divisional protrusions 311.

The divisional protrusions 311 have inverse triangular protrusions 311*d* that are vertically tapered.

The protrusions 311*d* prevent the tablets from being accumulated on the upper sides of the divisional protrusions 311 such that the tablets are smoothly discharged to the spaces between the divisional protrusions 311 due to the protrusions 311*d*.

The protrusions 311*d* are formed in the upper sides of the divisional protrusions 311 having different heights such that it is possible to prevent the tablets from being lodged or sandwiched between the divisional protrusions 311.

As described above, according to the present invention, it is possible to easily release the lodged tablets without damage. Therefore, it is possible to prevent tablets from being mixed with each other due to the damage of the tablets and to stably discharge the tablets such that it is possible to prevent a tablet cassette for a medicine packing machine from malfunctioning due to lodged tablets.

According to the present invention, the powders of the tablets generated in the cassette are easily removed such that it is possible to prevent the powders that reside in the cassette from adhering to another new tablets when the tablets accommodated in the cassette are exchanged with another kind of tablets.

According to the present invention, it is possible to prevent tablets from being sandwiched and accumulated and to thus stably sort and discharge the tablets such that it is possible to prevent the tablet cassette from being out of order.

According to the present invention, a brush can move vertically such that the tablet cassette according to the present invention can be easily applied to tablets having various lengths. Therefore, it is possible to sort and to discharge the tablets having various lengths using one tablet cassette such that it is not necessary to use separate rotating bodies for tablets having various lengths.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tablet cassette for a medicine packing machine, comprising:

a cassette for accommodating tablets;

a cassette support in which the cassette is mounted;

a rotating body rotatably installed in the cassette;

a driving motor installed in the cassette support so as to rotate the rotating body; and a brush protruded from the rear side of the cassette to the inside of the cassette;

wherein the rotating body comprises:

a cylindrical body having a conic upper surface;

a plurality of divisional protrusions provided on the outer circumference of the cylindrical body, the protrusions being spaced apart from each other and extending perpendicularly from the cylindrical body so as to form tablet chutes; and divisional grooves formed in the divisional protrusions such that the brush is inserted therein;

a plurality of downwardly inclined surfaces which are downwardly inclined on the upper surface of the divisional protrusions toward an outside direction; and plurality of additional protrusions protruded from a center portion of the downwardly inclined surfaces which are located above the downward inclined surfaces.

2. The tablet cassette for a medicine packing machine as set forth in claim 1, further comprising side inclined surfaces provided on both upper sides of the divisional protrusions such that the chutes are reversely tapered.

3. The tablet cassette for a medicine packing machine as set forth in claim 1, wherein the divisional grooves are larger than the thickness of the brush such that the brush moves vertically.

4. The tablet cassette for a medicine packing machine as set forth in claim 1, wherein the divisional protrusions have heights different from those of neighboring divisional protrusions.

5. The tablet cassette for a medicine packing machine as set forth in claim 1, further comprising a plurality of inclined round jaws formed on the conic upper surface of the rotating body at regular intervals to be symmetrically curved.

* * * * *